US005489241A

United States Patent [19]

Perrier

[11] Patent Number: 5,489,241

[45] Date of Patent: Feb. 6, 1996

[54] ULTRAVIOLET LIGHT ILLUMINATED BOWLING GAME

[75] Inventor: Brent Perrier, West Des Moines, Iowa

[73] Assignee: Brunswick Bowling & Billiards Corp., Muskegon, Mich.

[21] Appl. No.: 278,518

[22] Filed: Jul. 21, 1994

[51] Int. Cl.[6] ..... A63D 1/04

[52] U.S. Cl. ..... 473/115; 273/DIG. 24

[58] Field of Search ..... 473/54, 55, 58, 473/115, 116, 118, 125; 273/DIG. 24; 250/483.1, 484.1; 40/542, 543

[56] References Cited

U.S. PATENT DOCUMENTS

| | | |
|---|---|---|
| 280,807 | 7/1883 | Farley . |
| 716,645 | 12/1902 | Ransom . |
| 2,387,512 | 10/1945 | Hilberg . |
| 3,301,558 | 1/1967 | Clapham . |
| 3,630,601 | 12/1971 | Lehovec . |
| 3,709,495 | 1/1973 | Krombein . |
| 3,717,343 | 2/1973 | Hartford . |
| 3,917,264 | 11/1975 | Davidson et al. . |
| 3,918,719 | 11/1975 | Welch . |
| 3,971,560 | 7/1976 | Panosh . |
| 4,798,386 | 1/1989 | Berard . |
| 5,174,571 | 12/1992 | Aubusson et al. . |

*Primary Examiner*—William M. Pierce
*Attorney, Agent, or Firm*—Wood, Phillips, VanSanten, Clark & Mortimer

[57] ABSTRACT

A novel element is added to a bowling game by incorporating an intraviolet light sensitive dye or pigment in a bowling surface (24), a gutter (25), a bowling ball (26), and/or a bowling pin (28). A bowling establishment (10) is provided with an ultraviolet light source (50), (52), which, when conventional lighting, (42), (44), (46) is dimmed and/or turned off, will cause the ultraviolet light sensitive dye or pigment to fluoresce such that the components (24), (26), (30) fluoresce and glow to provide a pleasing effect attractive to bowlers.

7 Claims, 2 Drawing Sheets

ULTRAVIOLET LIGHT ILLUMINATED BOWLING GAME

FIELD OF THE INVENTION

This invention relates to a bowling game such as ten pin bowling, and more particularly, to a bowling game that may be played with one or more components of the game fluorescing in relatively dark condition as a result of sensitivity to ultraviolet light.

BACKGROUND OF THE INVENTION

As is well known, bowling as such as ten pin bowling, is played in two main forms. One form is league bowling wherein a plurality of teams compete against one another. The other form is so-called open bowling where individuals play strictly for recreational purposes and/or to compete amongst themselves on an individual basis.

Bowling proprietors, that is, the owners of bowling establishments, rely on open bowling to occupy their establishments when league play is not occurring. Without the revenue stream produced by open bowling, most proprietors would suffer financial difficulty. Consequently, it is desirable to maintain and increase the number of open bowlers using a given bowling establishment.

To accomplish this goal, variations on conventional bowling have been derived to entice open bowlers to a bowling establishment. One promotion that has worked well to attract open bowlers has been the so called "black out promotion", often referred to as "moonlight bowling". For this, the lights of the bowling establishment are dimmed and lighting above the lanes eliminated entirely. Moonlight bowling is especially popular with bowling proprietors because the relaxed, fun atmosphere that results attracts customers who are often not regular bowlers. These new customers, then, provide the means whereby the number of open bowlers using an establishment may be maintained and/or increased to thereby maintain and/or increase the revenue stream generated by open bowling.

While the advent of moonlight bowling has indeed succeeded in attracting non-regular bowlers, it remains nonetheless a goal of a bowling proprietor to achieve an even greater increase in non-regular bowlers attending his establishment. The present invention is directed to achieving that object.

SUMMARY OF THE INVENTION

It is the principal object of the invention to provide a new and improved bowling game. More specifically, it is an object of the invention to provide a variation in a bowling game that is particularly suited to attracting bowlers to open bowling at a bowling establishment, and to otherwise provide a variation on a conventional bowling game.

According to one facet of the invention, a bowling establishment is provided. The same includes an enclosure that may be selectively darkened. An elongated bowling game surface component is located in the enclosure and is flanked by gutter components. Bowling game pin components are located in the enclosure for disposition on the surface component. Similarly, bowling game ball components are disposed in the enclosure and are adapted to be rolled on the surface component at the pin components disposed thereon.

The enclosure includes selectively operable conventional lighting means for normally illuminating the enclosure. Also, included is an ultraviolet lighting means in the enclosure which is selectively operable for directing ultraviolet light at the surface component, the pin components disposed thereon and ball components rolled thereon. An ultraviolet light sensitive dye or pigment is disposed on at least one of the components at or sufficiently near the surface thereof as to visibly fluoresce when exposed to the ultraviolet lighting means. As a consequence, the enclosure may be selectively darkened with the conventional lighting means wholly or partially turned off and the ultraviolet lighting means operated so that the dye or pigment will fluoresce within the darkened enclosure as a bowling game is played therein.

The use of a fluorescing ultraviolet light sensitive dye or pigment adds a novel feature to so called "moonlight bowling" which is attractive to bowlers and draws them to the establishment having the same.

In one embodiment of the invention, the component provided with the dye or pigment is the bowling surface component. Alternatively, it may be the gutter components.

In another embodiment of the invention, the component having the dye or pigment are the bowling pin components.

In still another embodiment of the invention, the component having the dye or pigments are the ball components.

The invention also contemplates that any two, three or all of the components may be provided with the ultraviolet light sensitive dye or pigment.

According to another aspect of the invention, there is provided a bowling lane which includes an elongated structure having an upper, planar surface on which bowling balls may be rolled. An ultraviolet light sensitive dye or pigment is on the structure so as to be visible at the planar surface when fluorescing. The dye or pigment substantially covers either the entirety or simply part of the planar surface.

Included is a selectively operable source of ultraviolet light which is directed at the planar surface so that substantially the entirety of the surface or the selected part will be illuminated by fluorescence of the dye or pigment when the light source is operating.

In still another aspect of the invention, the bowling lane as just described, includes a film covering substantially the entirety of the planar or upper surface and an adhesive is interposed between the film and the upper surface for adhering the film to the upper surface. The ultraviolet light sensitive dye or pigment is incorporated in the bowling lane.

In a preferred embodiment, the dye or pigment is incorporated in the film and/or the adhesive.

In a highly preferred embodiment, the dye or pigment is incorporated in the adhesive.

Preferably, the dye or pigment is present in the range of 0.2 to about 3.0 weight percent of the dry adhesive.

The invention contemplates that the adhesive be present in an amount in the range of about 10 to about 150 lbs. dry adhesive per 3,000 square feet of the upper surface.

Most preferably, the dye or pigment is substantially colorless under normal lighting conditions or in daylight.

Preferably, the film is transparent.

According to still another facet of the invention, there is provided an ultraviolet light fluorescing protective coating for a bowling lane which includes a thin transparent film of a material selected from the group consisting of polyesters, polycarbonates, polystyrenes, polypropylene, polyethylene, polyvinyl chloride, acrylics, polyurethane, fluorocarbon polymers and nylon. A pressure sensitive adhesive is disposed on one side of the film and is selected from the group consisting of acrylic, vinyl-acrylic co-polymer, rubber-resin and silicone pressure sensitive adhesives. An ultraviolet light sensitive dye or pigment that is essentially colorless in daylight but which fluoresces in ultraviolet light is disbursed in the adhesive.

In a preferred embodiment, the protective coating has the adhesive coated on the film in an amount in the range of about 10 lbs. to about 150 lbs. per 3,000 square feet of surface of the one side of the film.

In a preferred embodiment, the film is a polyethylene terephthalate polyester and the adhesive is a vinyl-acrylic co-polymer adhesive.

Other objects and advantages will be apparent from the following specification taken in connection with the accompanying drawings.

DESCRIPTION OF THE PREFERRED EMBODIMENT

Figure 1:
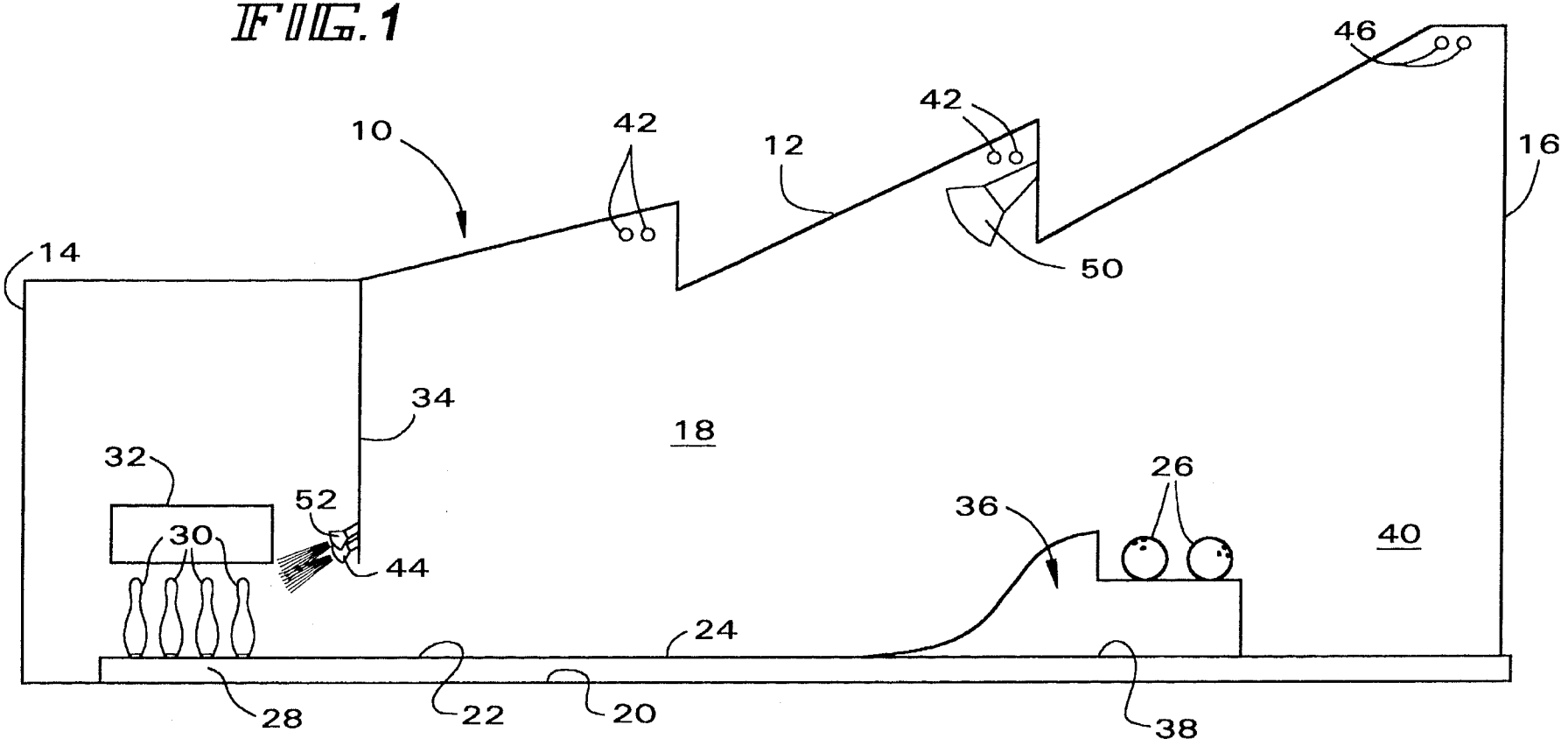
FIG. 1 is a somewhat schematic, side elevation of a bowling establishment made according to the invention.
Figure 2:
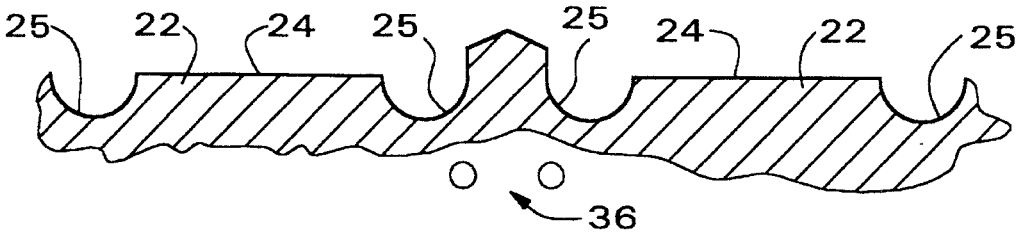
FIG. 2 is a somewhat schematic sectional view taken at right angles to the view of FIG. 1.

An exemplary embodiment of a bowling establishment made according to the invention is illustrated in FIG. 1 and somewhat schematic form. The same includes an enclosure, generally designated 10 having a ceiling 12 with a saw tooth configuration, opposed end walls 14 and 16, sidewalls 18 (only one of which is shown) and a floor 20. Supported on the floor 20 is a plurality of bowling lanes 22 and side-by-side relation as is well known. The lanes 22 may be either natural wood construction or so called synthetic lane construction and each has an upper surface 24 which is planar and which is flanked by gutters 25 (FIG. 2). The surface 24 is adapted to have one or more bowling balls 26 rolls thereon toward the pit end 28 thereof. As is well known, bowling pins 30 are spotted in a triangular configuration on the bowling surface 24 at the pit end 28, usually by an automatic pinsetter, shown schematically at 32.

The pinsetter 32 is hidden by a so called masking unit 34 which may be of conventional construction. A ball return and rack, generally designated 36, is located near the approach end 38 of the lanes. An area 40, shown extremely condensed in FIG. 1, to the right of the approach and of 38 of the lane 24 may house the usual amenities such as seating for the bowlers, a bar and/or grill, an area for entertaining children, equipment storage and rental locations, etc.

In the usual case, the enclosure 10 would be relatively window free. The windows, if any, will generally be located adjacent the area 40 and will severely limit the amount of light entering the establishment 10. For this reason, the ceiling 12, and the saw tooths thereof, is provided with conventional lane lighting, typically in the form of several fluorescent tubes 42. In addition, conventional lamps 44 may be disposed behind the masking unit 34 so as to illuminate the pit end 28 of each of the lanes 22.

In the area 40, additional conventional lighting in the form of selectively operable fluorescent lighting tubes 46 are located.

According to the invention, each lane 22 or lane pair is provided with at least one ultraviolet light source. In a preferred embodiment, one such light source is shown at 50 and is located in one of the saw tooths of the ceiling 12 while another is given the reference numeral 52 and may be mounted behind the masking unit 34.

In a highly preferred embodiment, the ultraviolet light sources 50 and 52 are selectively operable and provide ultraviolet light at a wave length in the range of about 200–400 nanometers. Shorter wave lengths are not preferred as being potentially environmentally unsound.

According to the invention, one or more of the bowling components in the enclosure 10 is provided with an ultraviolet light sensitive dye or pigment at or in sufficiently close proximity to its surface such that the dye or pigment will visibly fluoresce when subject to the ultraviolet light emitted by the sources 50 and 52. To enhance the effect of the fluorescing component, it is contemplated that a proprietor of the establishment 10 would turn off the lane illuminating lights 42, 44 and dim or turn off the lights 46. Inasmuch as the lights 46 illuminate an area 40 that might house a bar, a grill, etc., generally speaking, the lights 46 will only be dimmed.

If the bowling lane surface 24 is the component provided with the dye or pigment, generally only the source 50 will be illuminated. However, if the pins 30 are provided with the dye or pigment, the ultraviolet light source 52 will be illuminated.

Alternatively, if the balls 26 are provided with the dye or pigment, those of the ultraviolet light sources 50 and 52 may be illuminated.

As a preferred embodiment of the invention, the surface 24 is preferably provided with the dye or pigment. However, the gutters 25, balls 26 and/or the pins 30 may be the only components provided with the dye or pigment. Alternatively, any two, three or all four of the components may be provided with the dye or pigment.

Turning now to FIG. 2, the bowling lane 22, and the preferred manner of incorporating the dye or pigment therein, will be described. The lane 22 may be made up of a series of side-by-side boards 54 which, depending upon the location on the lane, will be made of pine or hardwood such as maple. Alternatively, the boards may be covered with a synthetic lane construction or dispensed with entirely. In the preferred embodiment, the boards 54 have their upper surface 56 covered by a protective coating generally of the type sold under the trademark "Guardian". This type of protective coating is disclosed more fully in U.S. Pat. Nos. 4,795,152, 4,867,816 and 4,944,514 to Suiter. The protective coating includes a clear, transparent, colorless film 58 of a thickness that typically will be in the range of 3 to 7 mils adhered to the upper surface 56 of the boards 54 by a layer of transparent pressure sensitive adhesive 60.

In a preferred embodiment, the film 58 is selected from the group consisting of polyesters, polycarbonates, polystyrenes, polypropylene, some types of polyethylene, poly vinyl chloride, acrylics, polyurethane, fluorocarbon polymers and some grades of nylon. In a highly preferred embodiment, the film is a polyethylene terephthalate polyester.

The adhesive 60 is a pressure sensitive adhesive selected from the group consisting of acrylic, vinyl-acrylic co-polymer, rubber-resin and silicone pressure sensitive adhesives of various sorts. A preferred adhesive is a vinyl-acrylic copolymer adhesive.

According to the invention, the adhesive 60 is present in the range of 10–150 lbs. of dry adhesive per 3,000 square feet of the surface of the film 58 to which it is applied. A preferred coating weight is 44 lbs. of dry adhesive per 3,000 square feet of film surface.

Many types of known ultraviolet light sensitive dyes or pigments 61 may be used. Selection of a particular dye or pigment will typically depend on the desired color to be generated when the dye fluoresces. A preferred dye is that known as "Columbia Blue"—Day-Glo Tracer Dye D-298 available from Day-Glow Color Corp. of Cleveland, Ohio. This particular dye is essentially colorless in daylight but fluoresces intense blue under ultraviolet light. It fluoresces brilliantly under ultraviolet light having a wave length in the range of 360–380 nanometers.

It is desirable that the dye be colorless under normal light or daylight so that its presence in the coating, film 58 or the adhesive 60 cannot be seen.

Preferably, the dye is used in the range of about 0.2 to about 3.0 weight percent of the dry weight of the adhesive.

The dye material may be disbursed in the adhesive 60 by any of a variety of conventional means.

Figure 3:
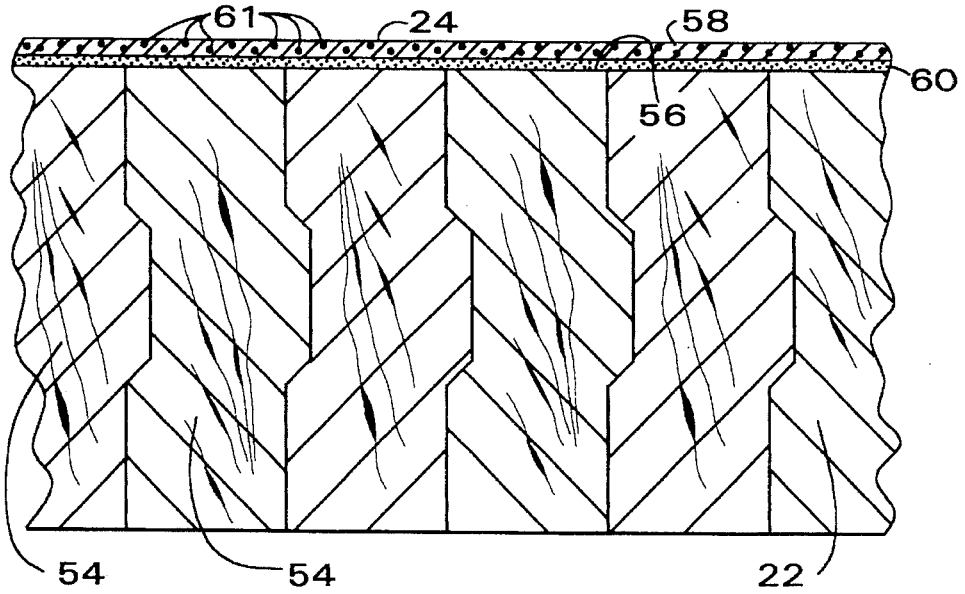
FIG. 3 is an enlarged, fragmentary sectional view of a bowling lane made according to the invention.

As noted previously, the ultraviolet sensitive dye or pigment may also be coated on the gutters 25 along their length. It may also be incorporated in the bowling balls 26. With reference to FIG. 3, as is well known, a conventional bowling ball is typically made up of an internal core 62 which may take on any of a variety of different shapes and which may be one or more pieces. The core 62 is surrounded by a cover 64. In the usual case, the cover 64 will be made up of polyester or urethane resins.

According to the invention, the dye or pigment, in dry form, may be ground up and mixed in with the cover stock used to form the cover 64. Generally speaking, because of the thickness of the cover 64, it will be desirable to use a higher weight percent of the dye or pigment than incorporated in the adhesive 60 to assure that a sufficient amount of the dye or pigment is at the surface of the ball so as to fluoresce when subject to ultraviolet light. Alternatively, the ball may be coated with a finish containing the dye.

Figure 4:
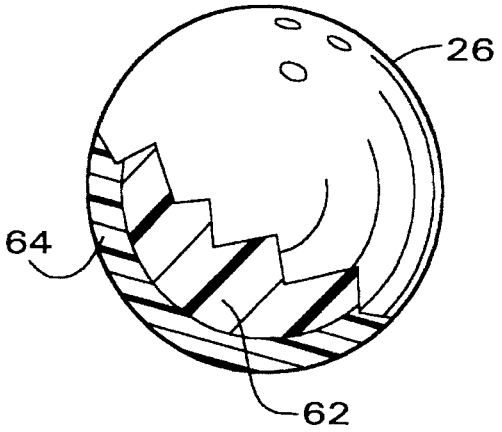
FIG. 4 is an elevation of a bowling ball made according to the invention with part of the same broken away.
Figure 5:
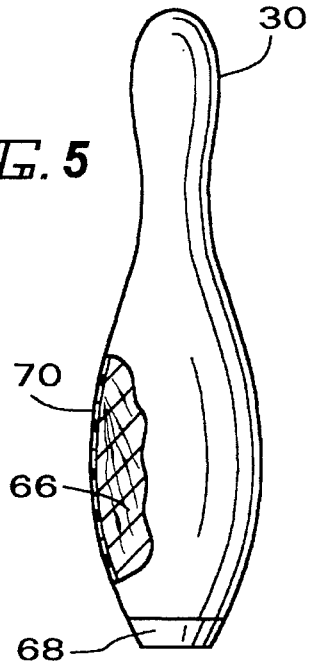
FIG. 5 is an elevation of a bowling pin made according to the invention, again with part of the same broken away.

Additionally, the pins 28 may incorporate an ultraviolet light sensitive dye or pigment. As seen in FIG. 4, a typical pin 28 includes a wooden core 66 provided with a plastic base 68. The core 66 is encapsulated in a protective skin 70. The skin 70 may be formed of any of a variety of materials as, for example, the polymeric material sold under the Registered Trademark "Surlyn". In this case, again, a dry dye or pigment is ground up and mixed into the Surlyn prior to its application to the pin core 66 and again, it may be necessary to use a larger weight percent of dye or pigment than with the adhesive 60 for the reason mentioned previously in connection with the ball 26.

Of course, in some instances, it may be desirable to simply paint an ultraviolet sensitive dye or pigment containing finish or coating on an object. In such a case, the dye or pigment may be mixed into a polyurethane coating material. For example, if the gutters 25 associated with the lane 22 are to be provided with the fluorescing dye or pigment, they may be painted with a conventional polyurethane finishing material containing the dye or pigment.

When the bowling surface is to fluoresce, substantially its entire surface or some selected part of its surface will be provided with the dye. If only a selected part is to be provided with the dye, it typically, but not always, will be that part of the lane nearest the pin deck 28. In some cases a "hybrid" installation may be used. For example, film 58 with a dye containing adhesive 60 may be installed at the approach end of the lane to provide protection for the bowling surface in the area where it takes the most abuse and a dye containing coating or finish used elsewhere on the lane.

To the extent that a bowling establishment or bowling lane, or protective coating made according to the invention can be visualized from the foregoing description, it will be appreciated that when in use and with the dye or pigment fluorescing while being exposed to ultraviolet light in a darkened establishment, a somewhat eerie, but nonetheless mysteriously pleasant sensation is felt by the observer. The components incorporating the dye or pigment cast a glow perceptible to all observers but not easily described. The novelty thereof is attractive to many people, and as a consequence, provides a novel addition to a conventional bowling game that is extremely well received by bowlers.

I claim:

1. A bowling lane comprising;

an elongated structure having an upper flat surface intended to support balls rolled by a bowler and flanked by gutters;

a film covering substantially the entirety of a selected part of said upper surface;

an adhesive interposed between said film and said upper surface for adhering said film to said upper surface;

an ultraviolet light sensitive dye or pigment incorporated in said lane in an area extending between said gutters; and an ultraviolet light source for impinging ultraviolet light on said lane;

whereby said dye or pigment will fluoresce to illuminate by said fluorescence said substantially the entirety of said selected part.

2. The bowling lane of claim 1 wherein said dye or pigment is incorporated in one of said film and said adhesive.

3. The bowling lane of claim 2 wherein said dye or pigment is in said adhesive.

4. The bowling lane of claim 3 wherein said dye or pigment is present in the range of about 0.2 to about 3.0 weight percent of the adhesive.

5. The bowling lane of claim 4 wherein the adhesive is present in an amount in the range of about 10 to about 150 lbs. per 3,000 square feet of said selected part.

6. The bowling lane of claim 1 wherein said film is transparent and said dye or pigment is incorporated in said adhesive.

7. A bowling lane comprising;

an elongated structure including an upper, planar surface on which bowling balls may be rolled and flanked by gutters;

an ultraviolet light sensitive dye or pigment on said structure so as to be visible at said surface when fluorescing and covering substantially the entirety of a selected area of said surface extending between said gutters; and a selectively operable source of ultraviolet light directed at said selected area;

whereby said substantially the entirety of a selected area of said surface will be illuminated by fluorescence of said dye or pigment when said source is operating.

* * * * *